US005184585A

United States Patent [19]

Wilson

[11] Patent Number: 5,184,585

[45] Date of Patent: Feb. 9, 1993

[54] APPARATUS AND METHOD FOR ADDING FLUID TO A FUEL IN AN ENGINE TO ENHANCE IGNITION

[75] Inventor: Richard F. Wilson, Calgary, Canada

[73] Assignee: The Dow Chemical Company, Midland, Mich.

[21] Appl. No.: 650,915

[22] Filed: Feb. 5, 1991

[51] Int. Cl.[5] ..... F02N 17/08

[52] U.S. Cl. ..... 123/179.8; 123/179.21

[58] Field of Search ..... 123/179 H, 179 B, 180 R, 123/180 E, 187.5 R, 557

[56] References Cited

U.S. PATENT DOCUMENTS

| | | | |
|---|---|---|---|
| 1,730.115 | 10/1929 | Bristol | 123/180 E |
| 2,175,743 | 10/1939 | Coffman | 123/179.2 |
| 2,851,027 | 9/1958 | Kivela | 123/187.5 R |
| 3,190,277 | 6/1965 | Tessier | 123/179.8 |
| 3,259,119 | 7/1966 | Kivela | 123/187.5 R |
| 3,416,507 | 12/1968 | Little | 123/179.8 |
| 3,448,733 | 6/1969 | Aske | 123/187.5 R X |
| 4,346,683 | 8/1982 | Burke | 123/180 R |
| 4,380,975 | 4/1983 | Powell | 123/179 H |
| 4,383,507 | 5/1983 | Powell | 123/179 H |
| 4,774,916 | 10/1988 | Smith | 123/180 R |
| 4,928,642 | 5/1990 | Atkinson et al. | 123/180 R |

FOREIGN PATENT DOCUMENTS

| | | | |
|---|---|---|---|
| 220523 | 8/1924 | United Kingdom | 123/179.14 |

*Primary Examiner*—Tony M. Argenbright

[57] ABSTRACT

An apparatus and method for adding a highly flammable volatile fluid to a fuel in an engine to enhance ignition of the engine wherein a predetermined quantity of the fluid is delivered at a controlled rate of flow to the engine in response to cranking thereof. The fluid is volatized as it flows from its source to the engine.

19 Claims, 1 Drawing Sheet

APPARATUS AND METHOD FOR ADDING FLUID TO A FUEL IN AN ENGINE TO ENHANCE IGNITION

TECHNICAL FIELD

The present invention relates to a fluid delivery system and method for enhancing low temperature operation of an engine. More specifically, the present invention relates to an apparatus and method for adding a highly flammable and volatile fluid to fuel in an engine, such as an internal combustion engine, to enhance ignition of the fuel under cold weather starting conditions.

BACKGROUND ART

The ignition of an internal combustion engine is a complex process involving the combination of many factors such as adequate cranking speeds, sufficient ignition energy, and the provision of an energetically combustible fuel/air mixture into the cylinder. During normal operation, both compression ignition (diesel) engines and spark ignition (gasoline) engines operate adequately on fuel delivered in near aerosol form. However, during the starting process in cold temperature environments, it has been generally found necessary to add volatile organic compounds (VOC) to fuel in order to provide combustible vapors for ignition. The principal engine ignition enhancing ingredient has been butane which has been blended into gasoline at refineries in anticipation of predicted weather conditions. These concentrations vary between summer and winter mixtures. That is, during the summer, a lower amount of butane is added to the gasoline and a higher amount is added during the winter.

The VOCs evaporating from gasoline are considered to be a contributor to smog. The EPA is preparing to limit the Reid vapor pressure of gasoline to meet more stringent VOC emission guidelines. Engines could become very difficult to start in cold weather as a result.

Prior methods have been devised in view of the aforementioned problem. The assignee of the present invention has developed a cylinder head recessed portion having a coating thereon comprising a thin film of synthetic resin which is thermally stable under the usual operating temperatures of the engine for controlling hydrocarbon emission. The U.S. Pat. No. 2,175,743 to Coffman, issued Oct. 10, 1939, discloses an auxiliary fuel tank system which under abnormal weather conditions supplies a liquid starting enhancer (butane or butane-containing gasoline) to a priming pump in response to operation of the starter of the engine. The U.S. Pat. Nos. 3,416,507 to Little, issued Dec. 17, 1968 and U.S. Pat. No. 4,346,683 to Burke, issued Aug. 31, 1982, both disclose supplementary fuel systems for enhancing low temperature operation. Both patents deal with an aerosol system. Hence, the aforementioned prior art patents all deal broadly with enhancer delivery during engine cranking.

The present invention provides an improvement over the prior art by providing means for injecting volatile components, such as fluids, into the intake manifold during starting/warm-up only and eliminating the need to have wasteful amounts of butane in the gasoline. The volatile components emitted from the fuel tank and carburetor are greatly reduced and it may be possible to eliminate the bulky activated carbon canisters now used to trap such losses. This invention could be used on diesel engines as well as gasoline engines. Further, any internal combustion engine starting process could benefit from the present invention, including aircraft reciprocating and turbine engines. The technology is particularly appropriate for emergency start equipment.

SUMMARY OF THE INVENTION

In accordance with the present invention, there is provided an apparatus for adding a highly flammable and volatile fluid to a fuel in an engine to enhance the ignition of the engine, the apparatus including means for metering a predetermined quantity of the fluid and delivery means operatively connected between the metering means and the engine. The delivery means comprises a tube of a predetermined inner diameter or bore for controlling the flow rate of the fluid. Electrical means is operatively connected to the latter for heating the tube means and volatilizing the fluid flowing therethrough. The metering means delivers the predetermined amount of fuel into the tube in response to cranking of the engine.

The present invention further provides a method of adding the highly flammable and volatile fluid to the fuel in the engine to enhance ignition of the engine. The method includes the steps of metering a predetermined quantity of the fluid and delivering the metered amount of fluid during engine cranking into a heated tube. The flow of the fluid is regulated through the tube. The fluid is volatilized within the tube and the volatilized fluid is conducted through the tube to the engine.

FIGURES IN THE DRAWINGS

Other advantages of the invention will become apparent from the following detailed description when considered in connection with the accompanying drawings wherein:

FIG. 1 is a schematic illustration of a first embodiment of the invention; and FIG. 2 is a schematic illustration of a second embodiment of the invention.

DETAILED DESCRIPTION

Figure 1:
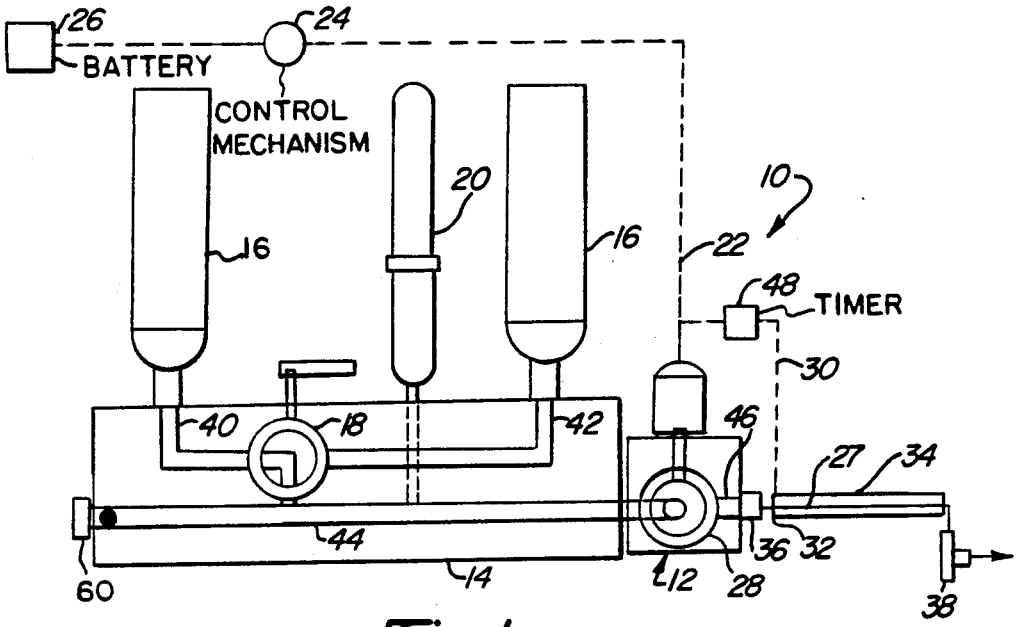

An apparatus for adding a highly flammable and volatile fluid to a fuel in an engine to enhance ignition of the engine is generally shown at 10 in FIG. 1.

The assembly 10 includes motorized metering mechanism 12 for metering a predetermined quantity of the fluid and is operatively connected in fluid communication with a manifold 14. The manifold 14 has mounted thereon a pair of liquefied petroleum gas (LPG) cylinders 16 which provides a fluid reservoir for the system. The liquefied petroleum gas could be butane, propane, or other fluids known in the art. The system may include one or more of the cylinders 16. The manifold 14 may be mounted so as to be easily accessible to the vehicle operator The manifold 14 may be mounted on an automobile firewall or in a vented enclosure in the vehicle trunk. The manifold 14 includes a three way ball, plug, or other valve 18 for permitting cylinder selection. The valve 18 could be operated manually as shown or automatically. Alternatively, the valve could be a three way solenoid valve. Further, the cylinder selection process could be completely automatic as is common in industrial gas manifolds.

The gas cylinders 16 could be the disposable Bernzomatic type torch cylinders. If this type of cylinder is used, the manifold 14 would require check valves to prevent loss of liquid during cylinder changes. Alternatively, the cylinders could be left in place indefinitely and filled through a manifold fill connection.

In order to provide a safe, net positive suction head for an application utilizing a metering pump to deliver the LPG to the intake manifold, one could use an inert gas pad over the liquid LPG utilizing bottles such as the Hydril type internal diaphragm or a Welker type free floating piston separator cylinder.

The apparatus 10 further includes a level gage 20 for indicating the level of gas in the cylinders. For purposes of illustration, a Krohne type magnetically coupled float gage 20 is shown. This function can be performed in numerous other ways well known to those skilled in the art. It is preferable to have a system that cheaply and reliably gives local indication of the volume of fluid within each cylinder 16 and has the capability of remote indication so that a dashboard mounted indicator of fuel level may be used. An automatic switchover and metering pump anti-dry run protection could be provided if desired.

The metering mechanism 12 is operatively connected, as shown schematically by line 22, to a control mechanism 24, schematically shown, for actuating the mechanism 12 to release a predetermined amount of fluid into a tube 27 in response to cranking of the engine (not shown). The control mechanism 24 is operatively connected to the engine battery 26 via the ignition or engine cranking switch. If the present invention is adapted to a late model automobile engine as an after market product, the control mechanism 24 could be an engine coolant temperature switch which senses the temperature of the engine. When the engine is at a temperature below a predetermined temperature, and the ignition system energized, the mechanism 24 actuates the metering mechanism 12 to deliver the predetermined amount of fluid into the tube 27.

The metering mechanism 12 as shown includes a three way ball valve 28 for delivering a measured amount of fluid to the tube member 27. This function could be equally well accomplished by a plug valve, an Isolok type sample valve, or any one of a number of other devices well known to those skilled in the art. Similarly, a large number of different types of metering pumps could be specified to provide precise and variable control of the flow of the LPG from the manifold 14.

The tube 27 is operatively connected between the metering mechanism 12 and the engine, the tube 27 having a predetermined bore size for controlling the flow rate of fluid therethrough. As schematically shown, the tube 27 also is operatively connected via an electrical connection, schematically indicated at 30, to the control mechanism 24 and eventually to the battery 26 for electrically heating the tube 27 and thereby volatilizing the fluid flowing therethrough once the mechanism 12 has delivered the predetermined amount of fuel into the tube 27 in response to cranking of the engine. The mechanism 12 is actuated to deliver the predetermined amount of fuel only when the temperature of the engine is below a certain predetermined temperature. Thus, the controlling factors are the energization of the ignition system, cranking of the engine, and the temperature of the engine.

The tube 27 provides a combination of flow smoothing and flow limiting by having a small bore, sized to give a reasonable pressure drop of between about 5 to 50 psig and, more preferably, a 15 to 30 psig pressure drop under average design flow conditions. The use of the small bore tubing 27 made from stainless steel provides sufficient electrical resistance so that a comfortable 100% safety factor in latent heat of vaporization can be provided autogenously by applying 12 volt energy from the battery 26 near the inlet 32 of the tube 27. If a 24 volt or other voltage system is used, adjustments would have to be made as to the thickness of the material and type of material used for the tubing.

The tube 27 can include insulation 34 thereabout to isolate the tube electrically and thermally from the surrounding environment. Further, the tube is electrically insulated at its inlet 32 by a plastic tubing connector 36 in fluid communication between the tube 27 and the metering mechanism 12. Thus, the tube 27 is insulated thermally and electrically along its length by insulation 34 as well as being thermally and electrically insulated from the mechanism 12 by the isolator 36. Additionally, the tube 27 may be grounded to the engine manifold.

Alternatively, commercially available heat traced tubing can be used.

In a preferred experimental embodiment, a 4 foot length of 3/16 inch by 0.020 inch bore diameter stainless steel tube 27 serves as the flow regulator, volatilization chamber, and heating element all in one. Preferably, the tube has a 0.015 inch inner diameter. However, its length, material of construction, and inner dimension may vary depending upon its location relative to the engine, the size of the engine to be started, the voltage of the electrical power applied, and other obvious factors. It may be preferable to provide an entrained droplet knockout capability in the system to improve the smoothness of the combustion process. This is not considered to be critical, however, because of the small flow.

As shown in FIG. 1, a simple droplet knock-out Tee 38 is shown operatively connected to the tube 27 in order to minimize liquid in the intake manifold of the engine. Alternatively, the supply of LPG could be delivered to the gasoline line or into a carburetor of a throttle body system as well as into the engine intake manifold.

In operation, during the period of engine cranking, the valve 28 remains in the delivery position as controlled from the switch 24 through connection 22. The connection 30 to the power supply 26 heats the tube 27 to flash the LPG into the intake manifold of the engine. The mechanism 12 returns to the fill position when the cranking ceases. The fluid flowing through the tube is volatized and its rate of flow is controlled by the bore of the tube. In the closed position of the valve 28, fluid from the cylinder 16 flows through passageways 40, 42 to the selection valve 18 which empties the fluid from either or both of the passageways 40, 42 into the main passageway 44 which leads to the metering pump valve 28. The level detector 20 is operatively connected to passageway 44 for detecting the amount of fluid therein.

The disclosed embodiment of the apparatus 10 is relatively tolerant to abusive, repeated, short period cranking cycles as the small bore tube limits the flow such that the storage cylinders will not empty and flood the engine.

Under severe, cold temperature conditions, the system could be modified to include a motorized valve similar to that shown at 12, but which is designed to retain, for example, 9 milliliters or other predetermined volume of LPG for 60 seconds of engine operation at idle. Actuation would occur when the cranking power is applied through the control mechanism 24 to the valve motor, causing it to dump its contents into an exit chamber 46 supplying the tube 27. Because of the thus extended period of LPG injection, the initiation of engine cranking will start a timer 48 which applies ignition-on 12 volt power to the tube 27 for 60 seconds. The 60-second period is illustrative; it may be extended or shortened depending upon weather conditions, engine size and type, and other known factors.

Figure 2:
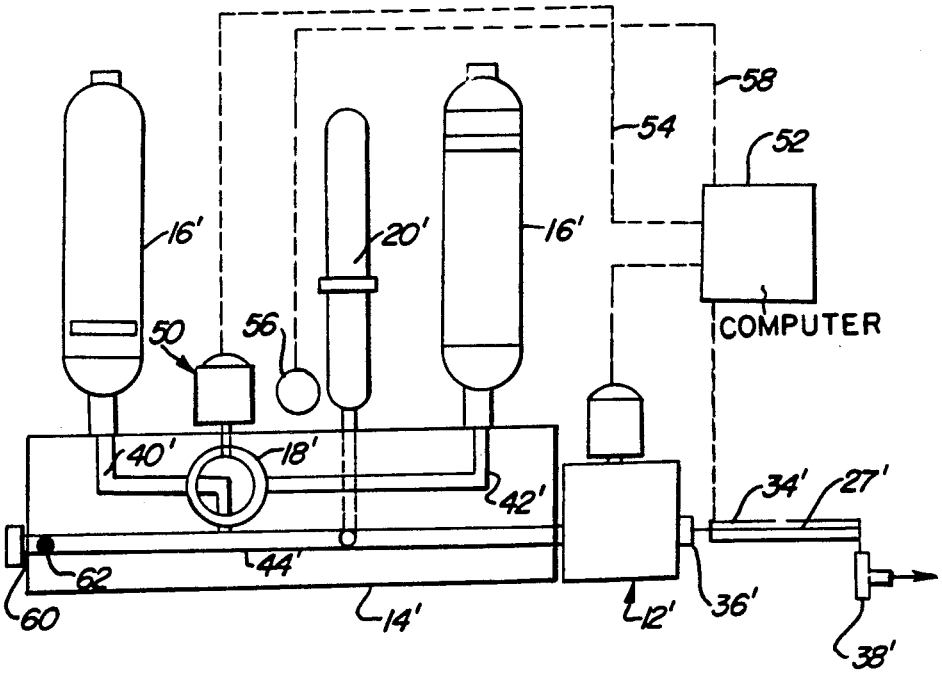

A second embodiment of the invention is shown in FIG. 2 and is adapted for more modern, fuel injected, computer controlled vehicles. Primed reference characters are used to indicate like components of the second embodiment which correspond to those of the first embodiment.

The apparatus 10' is fitted with a motorized cylinder selection valve 50 which is under the control of an on-board computer 52. Reference character 54 indicates schematically the electrical connection between the computer 52 and the electrically operated valve 50. A low level switch 56 is fitted to the level indicator 20' and is operatively connected to the computer 52, as schematically shown by connection 58, which causes the computer 52 to select alternate LPG cylinders and/or disable the metering mechanism 12' to prevent dry running damage in the event of LPG exhaustion from the cylinders 16'. The system could be adapted to be operatively connected to a dashboard indicator of these events.

The apparatus 10' is illustrated as including a small, metering motorized pump 12', but it could be any one of a number of alternative metering/control systems, under the control of the engine computer 52 such that the LPG delivery could be made to track the engine start, acceleration, and slow to idle program commonly employed. In view of the poor net positive suction head performance of metering pumps and the poor net positive suction head availability inherent in a liquefied gas storage system, it would be appropriate to use a Welker type gas load free floating piston type cylinder, illustrated in FIG. 2. It is possible to pad the top of the cylinder 16' to a normal 20 psig with inert gas such as nitrogen before filling the cylinder 16' through the bottom in the normal manner. As shown in FIG. 2, the manifold 14' includes an LPG cylinder fill nozzle 60 and a schematically shown check valve 62 which permits filling of the cylinders 16' through the manifold 14'. In this way there always will be adequate net positive suction head performance for the mechanism 12'.

The computerized system as shown is relatively tolerant of abusive engine racing immediately after start-up and could provide LPG delivery on a controlled basis as long as the computer system deemed necessary prior to self sustaining, gasoline only operation.

The invention further provides a method of adding the highly flammable and volatile fluid to a fuel in the engine to enhance ignition of the engine, the method generally including the steps of metering a predetermined quantity of the fluid, delivering the metered amount of the fluid during engine cranking to the heated tube 27, regulating the flow of fluid through the tube 27, and volatilizing the fluid within the tube 27. The volatilized fluid is conducted through the tube 27 to the engine fuel intake system.

Unlike the known prior art systems, the invention enables a single tube to control and smooth the flow of fluid, volatilize the fluid, and conduct the fluid between the source of such fluid 12 and the engine.

What is claimed is:

1. An apparatus for adding a highly flammable and volatile fluid to a fuel in an engine to enhance ignition of the engine, said apparatus comprising: fluid discharge means for discharging a predetermined quantity of said fluid from a source thereof; fluid delivery means operatively connected between said discharge means and the engine for delivering said fluid at a controlled flow rate to said engine; and means operatively connected to said delivery means and responsive to initiation of cranking of the engine for heating said delivery means, volatilizing the fluid flowing therethrough, and delivering the volatized fluid to the engine.

2. An apparatus as set forth in claim 1 further including pressure means for applying a positive flow pressure on said fluid, said delivery means exerting a resistance to the flow of said fluid.

3. An apparatus as set forth in claim 2 wherein said discharge means includes connector means for operatively connecting said discharge means to control means for actuating said discharge means to release the predetermined amount of fluid to said delivery means in response to cranking of the engine.

4. An apparatus as set forth in claim 3 further including a manifold operatively connected between said source of said fluid and said discharge means, said manifold including valve means for controlling the flow of the fluid therethrough.

5. An apparatus as set forth in claim 4 wherein said discharge means includes a three way valve, said valve having an inner chamber for trapping said predetermined volume of fluid therein prior to its for release to said delivery means.

6. An apparatus as set forth in claim 5 wherein said control means includes sensor means for sensing the temperature of the engine, said control means being operative to actuate said valve only when the engine temperature is below a predetermined temperature.

7. An apparatus as set forth in claim 6 wherein said delivery means includes an electrically conductive thermally sensitive tube operatively connected to an electrical power source operable to effect heating of said tube when the engine temperature is below said predetermined temperature.

8. An apparatus as set forth in claim 7 wherein said tube is formed of stainless steel.

9. An apparatus as set forth in claim 8 wherein said discharge means includes an outlet port, said apparatus further including electrical isolator means connecting said tube to said outlet port for electrically insulating said discharge means from said tube.

10. An apparatus as set forth in claim 8 further including thermal insulator means for thermally insulating said tube from the ambient environment.

11. An apparatus as set forth in claim 8 further including ground means for grounding said tube.

12. An apparatus as set forth in claim 1 further including an exit chamber in fluid communication between said discharge means and said delivery means for containing the fluid discharged from said discharge means and feeding the fluid into said delivery means.

13. An apparatus as set forth in claim 1 further including timer means for actuating said means for heating said delivery tube means for a predetermined period of time after the commencement of engine cranking.

14. An apparatus as set forth in claim 1 including computer control means, said discharge means including a pump operatively connected to the computer control means.

15. A method of adding a highly flammable and volatile ignition enhancing fluid to an internal combustion engine, said method comprising the steps of: discharging a quantity of the fluid from a source thereof in response to initiation of cranking of said engine; delivering said to said engine at a controlled rate of flow; heating the fluid as it flows toward said engine to volatize said fluid; and discontinuing the delivery of said fluid to said engine following the delivery thereto of a predetermined quantity of said fluid.

16. A method as set forth in claim 15 further including the step of applying force to the fluid delivered to said engine for further controlling the rate of flow of the fluid.

17. A method as set forth in claim 16 further including the step of sensing the temperature of the engine, and disabling the discharge of said fluid from said source when the engine temperature is above a predetermined temperature.

18. A method as set forth in claim 15 wherein said fluid is volatized by applying heat thereto.

19. A method as set forth in claim 15 including discontinuing the volatization of said fluid a predetermined period of time following ignition of the engine.

* * * * *